US007726521B2

(12) United States Patent
Bassett et al.

(10) Patent No.: US 7,726,521 B2
(45) Date of Patent: Jun. 1, 2010

(54) LIQUID DISPENSER

(75) Inventors: Wade M. Bassett, Albia, IA (US); Lisa L. Bassett, Albia, IA (US)

(73) Assignee: MBHD, LLC, Albia, IA (US)

( * ) Notice: Subject to any disclaimer, the term of this patent is extended or adjusted under 35 U.S.C. 154(b) by 899 days.

(21) Appl. No.: 10/919,975

(22) Filed: Aug. 17, 2004

(65) Prior Publication Data

US 2005/0211729 A1 Sep. 29, 2005

(51) Int. Cl.
*B65D 88/54* (2006.01)
*A45D 42/14* (2006.01)

(52) U.S. Cl. ..... 222/180; 222/321.7; 248/206.3; 248/205.5

(58) Field of Classification Search ..... 222/180, 222/181.1, 181.2, 181.3, 321.7, 478, 481.5, 222/482; 248/205.5, 683, 206.2, 363, 206.3, 248/222.41, 231.9
See application file for complete search history.

(56) References Cited

U.S. PATENT DOCUMENTS

| | | | | | |
|---|---|---|---|---|---|
| 952,495 | A | * | 3/1910 | Austin | 248/205.8 |
| 2,093,942 | A | * | 9/1937 | Stuff | 222/181.2 |
| 2,271,219 | A | | 1/1942 | Brunke | |
| 2,613,852 | A | * | 10/1952 | Frederick | 222/100 |
| 2,771,219 | A | * | 11/1956 | Dewey | 222/93 |
| 2,872,076 | A | * | 2/1959 | Bloom | 222/651 |
| 3,078,017 | A | * | 2/1963 | Waskonig et al. | 222/181.3 |
| 3,105,612 | A | | 10/1963 | Krasnoff | |
| 3,319,838 | A | | 5/1967 | Bayles | |
| 3,388,835 | A | * | 6/1968 | Naughten | 222/78 |
| 3,459,343 | A | * | 8/1969 | Rasmussen | 222/477 |
| 3,608,793 | A | | 9/1971 | VanLobensels | |
| 3,623,641 | A | * | 11/1971 | Hansen et al. | 222/105 |
| 3,940,819 | A | | 3/1976 | McMackin | |
| D243,731 | S | | 3/1977 | Donaldson | |
| 4,020,975 | A | * | 5/1977 | Stauffer | 222/93 |
| 4,135,260 | A | | 1/1979 | Gresh | |
| 4,177,965 | A | | 12/1979 | Blaszkowski | |
| 4,277,042 | A | | 7/1981 | Ash | |
| 4,286,407 | A | | 9/1981 | Adickes | |
| 4,309,014 | A | | 1/1982 | Blaszkowski | |
| 4,397,050 | A | | 8/1983 | Davis | |
| 4,529,278 | A | | 7/1985 | Nugent | |
| 4,582,227 | A | * | 4/1986 | Kanfer | 222/153.09 |
| 4,606,520 | A | | 8/1986 | Riniker | |
| 4,615,476 | A | * | 10/1986 | Hobbs et al. | 222/153.09 |
| 4,630,794 | A | | 12/1986 | Ross | |
| 4,651,902 | A | * | 3/1987 | Hobbs et al. | 222/153.09 |
| 4,728,006 | A | | 3/1988 | Drobish | |
| 4,754,503 | A | | 7/1988 | Martin | |
| 4,771,272 | A | | 9/1988 | Barnes | |
| 4,775,124 | A | | 10/1988 | Hicks | |
| D304,791 | S | | 11/1989 | DeVigili | |

(Continued)

*Primary Examiner*—Kevin P Shaver
*Assistant Examiner*—Stephanie E Tyler
(74) *Attorney, Agent, or Firm*—McKee, Voorhees & Sease, P.L.C.

(57) ABSTRACT

A liquid dispenser includes a body having an inner cavity for containing liquid, and an aperture providing access to the inner cavity. A push pump is fitted within the aperture. At least one height adjustable mount is connected to the body for releasably attaching the body to a surface. Preferably the body is conformingly shaped. An adapter can connect the liquid dispenser to a liquid container for filling the liquid dispenser.

15 Claims, 16 Drawing Sheets

U.S. PATENT DOCUMENTS 4,930,670 A * 6/1990 Kuo ..... 222/321.3
4,938,346 A 7/1990 Urbano
4,945,598 A 8/1990 Racioppi
4,951,533 A 8/1990 Hillinger
4,982,874 A 1/1991 Pringle
5,011,316 A 4/1991 Damon
5,014,860 A 5/1991 Emery
5,028,026 A 7/1991 Philipps
5,031,258 A 7/1991 Shaw
5,071,387 A 12/1991 Pottick
5,177,829 A 1/1993 Simpson
5,230,648 A 7/1993 Kelley
5,232,189 A 8/1993 Koch
5,238,106 A 8/1993 Nguyen
5,243,931 A 9/1993 McDonough
5,264,145 A 11/1993 French
5,312,018 A 5/1994 Evezich
5,318,202 A 6/1994 D'Andrade
5,404,598 A 4/1995 Hadsell
5,509,529 A 4/1996 Kelley
5,546,614 A 8/1996 King
5,548,853 A 8/1996 Johnson
5,573,214 A * 11/1996 Jones et al. ..... 248/311.2
5,625,908 A 5/1997 Shaw
5,655,999 A 8/1997 Drew
5,680,929 A 10/1997 Von Seidel
5,690,096 A 11/1997 Burch
5,704,078 A 1/1998 Chandler
5,757,275 A 5/1998 Mowry
5,772,079 A * 6/1998 Gueret ..... 222/321.7
5,810,201 A 9/1998 Besse
5,850,945 A 12/1998 Frankel
5,857,594 A 1/1999 Ozturk
5,865,325 A 2/1999 Comstock
5,894,611 A 4/1999 Toro
5,920,926 A 7/1999 Torres
5,938,083 A * 8/1999 Quinn ..... 222/186
5,966,752 A 10/1999 Abugideiri
6,010,683 A 1/2000 Fischer
6,076,223 A 6/2000 Dair
6,092,772 A 7/2000 Garcia
6,116,045 A 9/2000 Hodosh
6,139,820 A 10/2000 Fischer
6,141,816 A 11/2000 Burnett
6,152,294 A 11/2000 Weinberg
6,314,592 B1 11/2001 Stein
6,315,163 B1 11/2001 Shu
6,330,948 B1 12/2001 Leto
6,341,508 B1 1/2002 Minassian
6,343,712 B1 * 2/2002 Flackett et al. ..... 222/78
6,363,739 B1 4/2002 Hodosh
6,457,190 B1 10/2002 Stein
6,481,239 B2 11/2002 Hodosh
6,530,502 B2 3/2003 Neal
6,669,033 B1 * 12/2003 Lian ..... 211/87.01
6,729,504 B2 * 5/2004 Bougamont et al. .... 222/189.09
6,808,090 B2 * 10/2004 Pedersen ..... 222/181.3
6,966,530 B2 * 11/2005 Hsu ..... 248/206.2
7,481,336 B2 * 1/2009 Arghyris et al. ..... 222/321.7

* cited by examiner

LIQUID DISPENSER

BACKGROUND OF THE INVENTION

The present invention relates to the dispensement of liquids. More particularly, but not exclusively, the present invention relates to a device and method for dispensing liquids such as soap.

Liquid dispensers that incorporate push pumps are found in various places throughout the home, including in the kitchen and bathroom. These liquid dispensers can be used for dispensing soap, lotion, or other types of liquid. Liquid dispensers for dispensing soap are often preferred over using a bar of soap because liquid dispensers are generally cleaner and create less mess than bars of soap. Nevertheless, despite this advantage of liquid dispensers, problems remain. These problems are magnified when young children use liquid dispensers. For example, children often cannot reach the soap on the back of the sink. Therefore, the soap is difficult to dispense for the children, and they may not even use it. Moreover, children may be inclined to pump more soap than is necessary thereby wasting the soap. Children may also pump soap and dispense it onto the countertop. Children are not likely to clean the countertop.

Of course, liquid dispensers are found in environments outside the home as well, including, for example, in boats, recreational vehicles (RVs), and other environments where liquid may need to be dispensed.

Therefore, what is needed is an improved dispenser for dispensing liquid.

Thus, it is a primary object, feature, or advantage of the present invention to improve upon the state of the art.

It is a further object, feature, or advantage of the present invention to provide a liquid dispenser that reduces the likelihood of messes being made.

Another object, feature, or advantage of the present invention is a liquid dispenser that can be used by children which promotes better hygiene and prevents the spread of germs.

Yet another object, feature, or advantage of the present invention is to provide a liquid dispenser with an ergonomic design, making the dispenser adaptable to various environments including, but not limited to the home environment, boats, and RVs.

These and/or other objects, features or advantages of the present invention will become apparent from the specification and claims. The present invention is not to be limited by these objects, features, or advantages.

SUMMARY OF THE INVENTION

One aspect of the present invention is a liquid dispenser. The liquid dispenser includes a body having an inner cavity for containing liquid and an aperture for providing access to the inner cavity. There is also a push pump removeably fitted with the aperture. At least one height adjustable mount is connected to the body for releasably attaching the body to at least one surface. The height adjustable mount can include a base, a neck connected to the base, and a head connected to the neck. The base can be releasably attachable to the at least one surface. The neck can be threaded and/or extendable. The base can include a suction cup or an adhesive. The liquid dispenser can have an adjustable output. The liquid dispenser may also include a support member extending outwardly from the liquid dispenser to assist in the pumping process.

According to another aspect of the present invention, a liquid dispenser includes a conformingly shaped body having an inner cavity for containing liquid, and an aperture providing access to the inner cavity. A push pump removeably fitted with the aperture. There is at least one mount connected to the body for releasably attaching the body to a surface. The conformingly shaped body includes a top end and a bottom end opposite the top end. The push pump is positioned at the top end such that the bottom end conformingly fits proximate a surface to which the body is mounted. Thus, the bottom end may not be substantially flat and the liquid dispenser may not be capable of being freestanding on the bottom end.

According to another aspect of the invention, a system for dispensing liquid includes a liquid dispenser comprising a body having an inner cavity for containing the liquid and an aperture providing access to the inner cavity, a push pump removeably connected to the liquid, at least one mount connected to the body. The system also includes an adapter for filling the liquid dispenser, the adapter comprising a first end having a first aperture and a second end having a second aperture, the adapter removeably fitting to the body. The adapter allows for easy filling of a liquid dispenser from a container of liquid and is especially useful when filling the liquid dispenser with liquid from a container that is nearly empty. The adapter is especially useful when the liquid dispenser is conformingly shaped to fit a surface and cannot rest freestanding on its bottom end. The adapter also allows the liquid dispenser to be filled without unmounting the liquid dispenser.

According to yet another aspect of the invention, a liquid dispenser, a height adjustable suction cup is disclosed. The height adjustable suction cup includes a base adapted for connection to a surface. There is a head adapted for operatively connecting to a structure to be supported, such as a liquid dispenser. There is also a neck extending between the base and the head. The suction cup has a height defined as a distance from the base at the surface to the structure being supported. The neck is adapted to adjust the height. The neck can be threaded to provide for screwing the suction cup into the structure to be supported in order to adjust the height. Alternatively, the neck can include a number of segments with one or more of the segments being removable in order to adjust the height of the suction cup.

As previously mentioned, one aspect of the invention provides for the liquid dispenser to have an adjustable output. To elaborate on this aspect of the invention, the liquid dispenser includes a dispenser body and a push pump operatively connected to the dispenser body. The push pump includes a head and a neck operatively connected to the head. The neck extends downwardly into a pump area. There is also a stop member adjustably positioned in the pump area and operatively connected to the neck. There is a spring positioned beneath the stop member. The liquid dispenser has a first position where the stop member is a first distance from the spring in order to provide a stroke of a first length. The liquid dispenser also has a second position wherein the stop member is a second distance from the spring in order to provide a stroke of a second length, the second length longer than the first length. By pulling up on the head of the push pump, the position of the stop member is adjusted upward to provide a longer stroke, resulting in dispensement in a greater amount of liquid. Such a feature is particularly useful when the liquid dispenser is being used by both children and adults. In the normal mode of operation, used by children, only a small amount of liquid is dispensed. If the adult so chooses, the adult can pull the pump head upward before using the liquid dispenser in order to increase the amount of liquid dispensed.

DETAILED DESCRIPTION OF THE PREFERRED EMBODIMENT

Figure 1A:
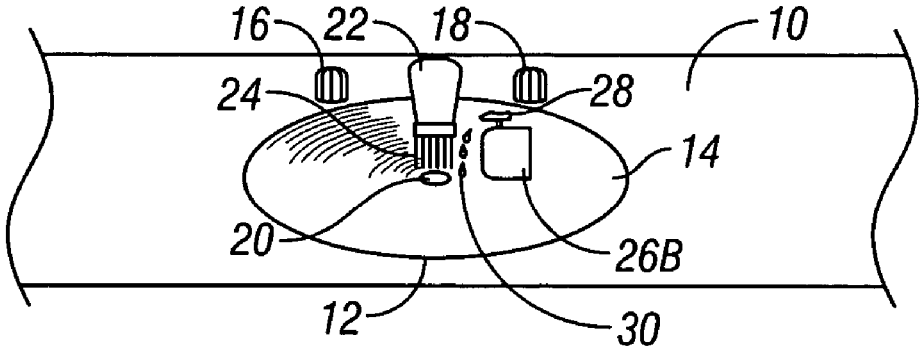
FIG. 1A is a view of a liquid dispenser of the present invention removeably attached to the inside of a sink.

The present invention provides for a liquid dispenser that can be removeably attached to a sink or other surface using suction cups, preferably height adjustable suction cups. FIGS. 1A-1D illustrate the present invention in various environments. The environments shown are not to be limiting, but merely representative of the environments in which the liquid dispenser of the present invention is used. It should be appreciated that different types of liquid may be used in different environments. The present invention is in no way limited to the particular type of liquid used. The liquid can be, without limitation, soap, shampoo, gel, foam, hair care liquid, a cleaning liquid, or an edible liquid (such as various condiments). FIG. 1A illustrates a bathroom countertop 10. A sink 12 is positioned within the bathroom countertop 10. The sink 12 has an inside surface 14. The inside surface 14 of the sink is typically contoured or sloped inwardly from the countertop 10 to the drain 20 or otherwise ellipsoidally shaped, although the adjustability of the liquid dispenser of the present invention allows it to accommodate a number of different types of sinks or other surfaces. The fixtures 16 and 18 are also shown. These fixtures are used for controlling hot and cold water. Also, a faucet 22 is shown. Water 24 is shown flowing from the faucet 22 to the drain 20. A liquid dispenser 26B is shown with a push pump 28 for pumping, in this case, liquid soap 30 from the dispenser 26B. The present invention fully contemplates that other types of liquids can be dispensed, including but not limited to lotions, hair care products, etc.

Figure 1B:
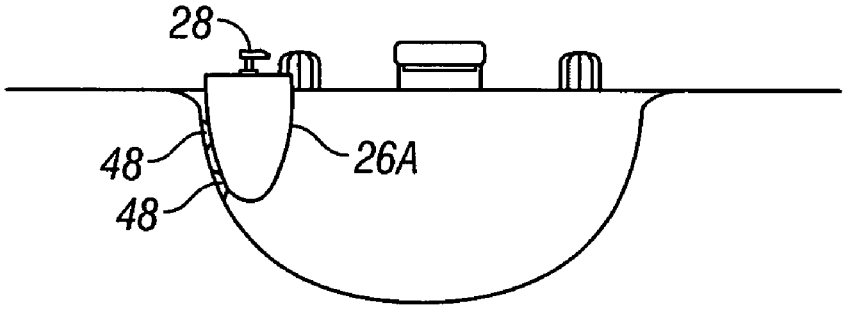
FIG. 1B is a sectional view of a liquid dispenser of the present invention removeably attached to the inside of a sink showing the body of the liquid dispenser conforming to the ellipsoidal surface of the sink.

FIG. 1B illustrates a sectional view of a liquid dispenser 26A placed in a sink having an ellipsoidal shape. The liquid dispenser 26A is attached to the sink through suction cups 48. The liquid dispenser 26A conformingly fits the ellipsoidally shaped sink.

Figure 1C:
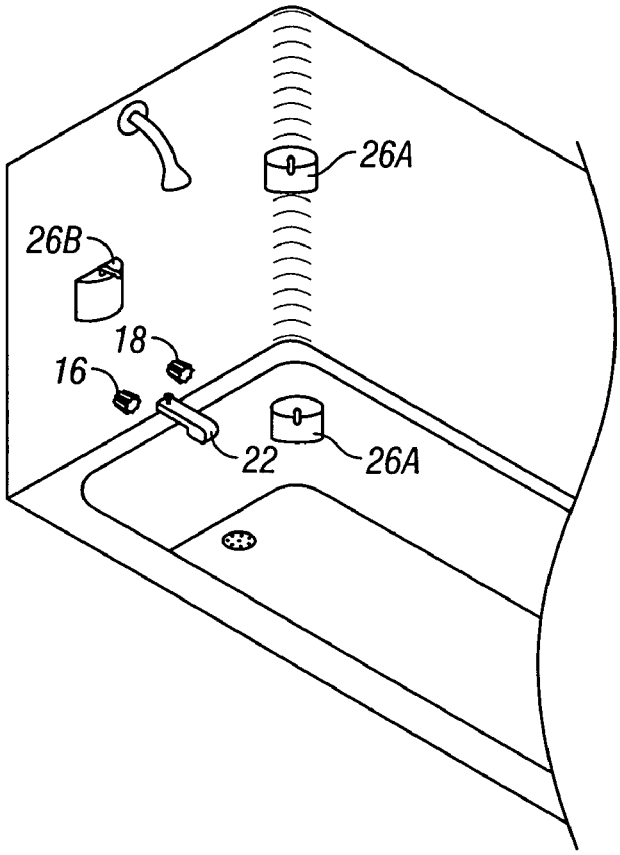
FIG. 1C is a perspective view of multiple liquid dispensers mounted in a bath area.

FIG. 1C illustrates a perspective view of liquid dispensers 26A and 26B in a bath area. The liquid dispensers (26A, 26B) can be placed in the bath tub, on the walls of a shower, or elsewhere.

Figure 1D:
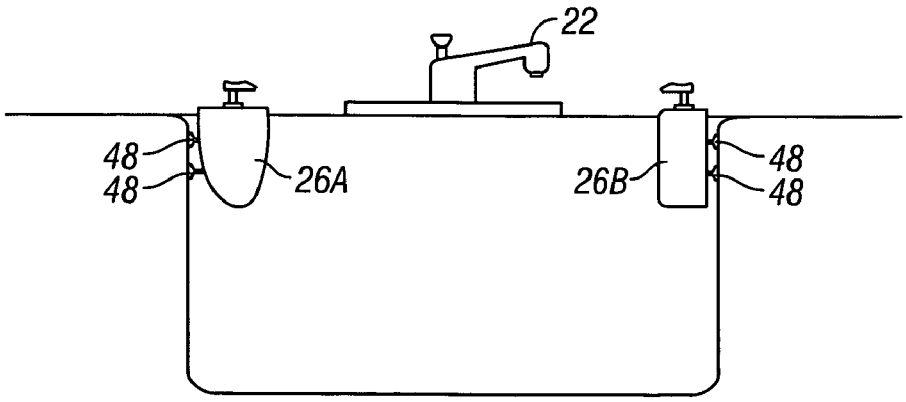
FIG. 1D is a sectional view of multiple liquid dispensers mounted in a sink.

FIG. 1D illustrates a sectional view of a kitchen sink with liquid dispensers 26A and 26B. The sink is generally rectangular in nature. The suction cups 48 of each liquid dispenser (26A, 26B) are preferably adjusted to fit against the surface of the walls of the sink.

Figure 2A:
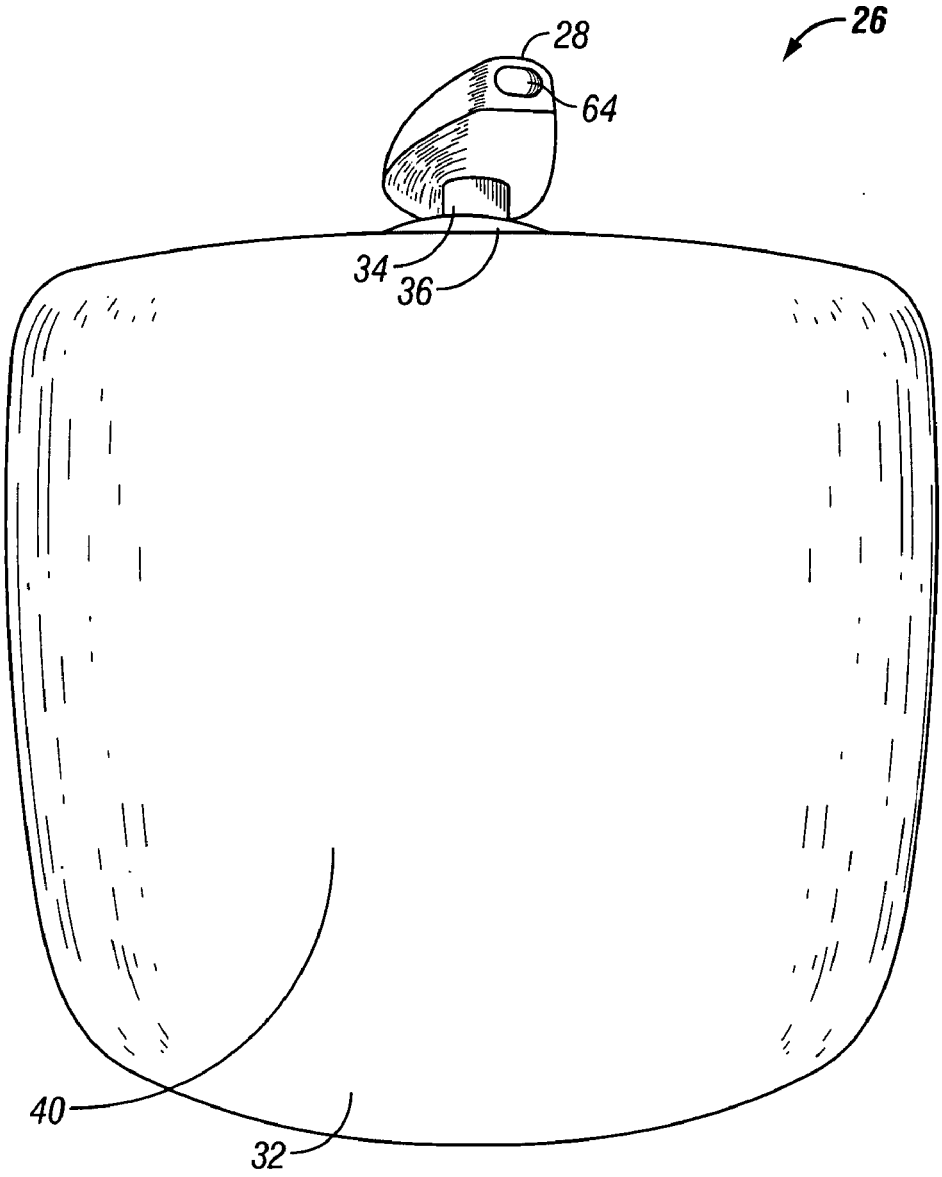
FIG. 2A is a front perspective view of one embodiment of a liquid dispenser according to the present invention.
Figure 2B:
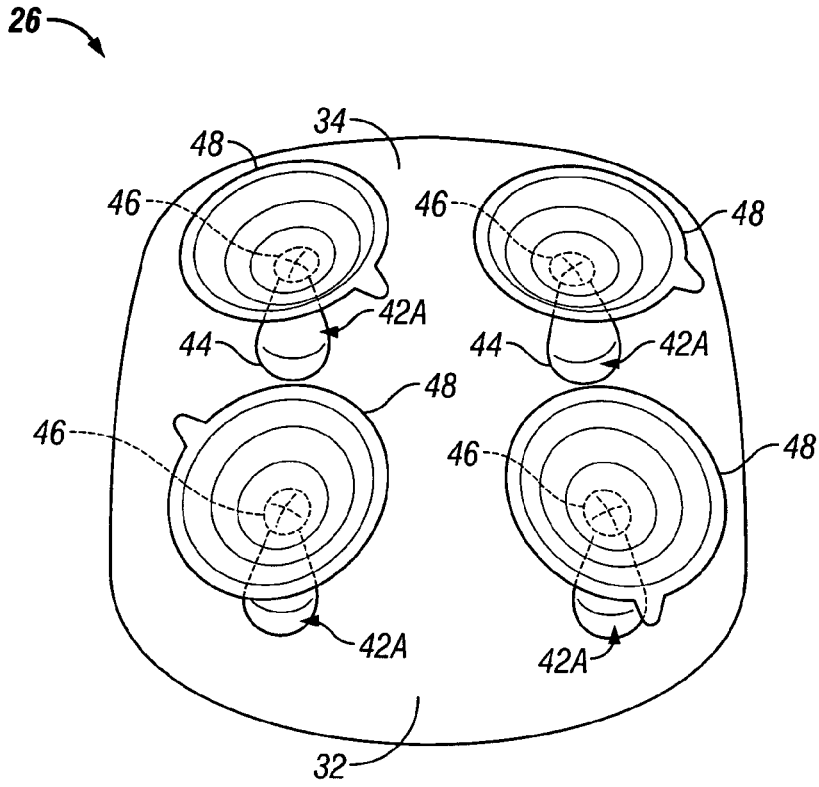
FIG. 2B is a rear perspective view of one embodiment of a liquid dispenser according to the present invention.

FIG. 2A illustrates a front perspective view of a liquid dispenser 26. The liquid dispenser 26 has a dispenser body 32 that forms an inner cavity for containing liquid. The dispenser 26 has a removable pump 28. A shoulder 36 and a neck 34 of the push pump 28 are used for dispensing liquids from within the dispenser body 32. The push pump 28 includes an outlet 64 from which liquid is dispensed. The dispenser 26 has a front surface or side 40 shown in FIG. 2A. FIG. 2B illustrates an opposite side of the dispenser 26. The present invention contemplates that other types of pumps can be used, including but not limited to, full stroke, low-profile, adjustable stroke, short stroke, electric, electronic activation, etc.

In FIG. 2B, the dispenser body 32 is shown. A neck 34 of the dispenser body 32 can extend downwardly into the dispenser body 32. A plurality of apertures 42A are shown. Suction cups 48 are adapted to fit within the apertures 42A. The apertures 42A have a larger opening portion 44 and a smaller opening portion 46. This allows the suction cups 48 to be inserted into the larger portion 44 of the aperture and then slid to the smaller portion 46 of the aperture in order to be secured. The present invention contemplates that other means for securing or fastening the suction cups 48 to the dispenser body 32 can be used, including permanent attachment. Moreover, the present invention contemplates that the suction cups 48 can be adjustable or fixed in various embodiments.

Figure 2C:
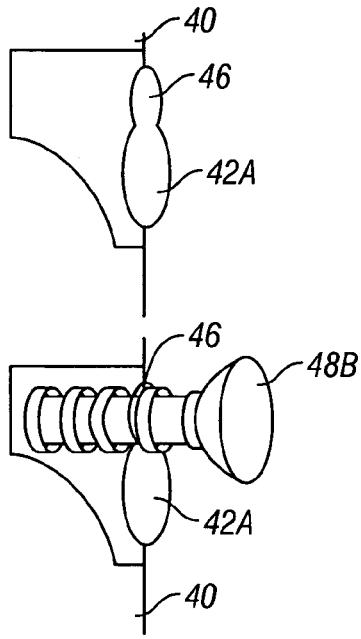
FIG. 2C is a sectional view showing openings in the dispenser body for receiving suction cups with an adjustable suction cup fitted within one of the openings.

FIG. 2C illustrates how a suction cup can be removeably connected to a back surface 40 of a liquid dispenser. There is at least one opening 42A for accepting a suction cup 48B. The opening 42A allows a suction cup 48B to be placed in the opening 42A and then the suction cup 48B can be secured by sliding it into the smaller opening 46.

Figure 3A:
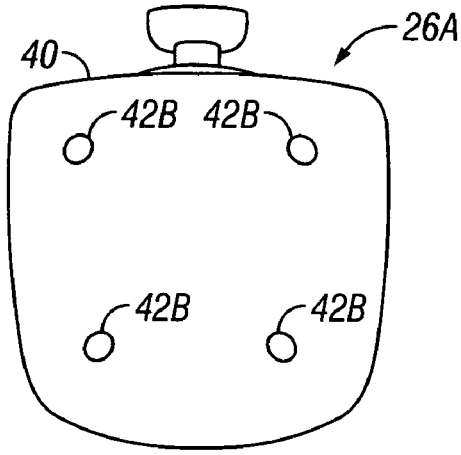
FIG. 3A is a rear view of one embodiment of the dispenser body showing openings for receiving suction cups.
Figure 3B:
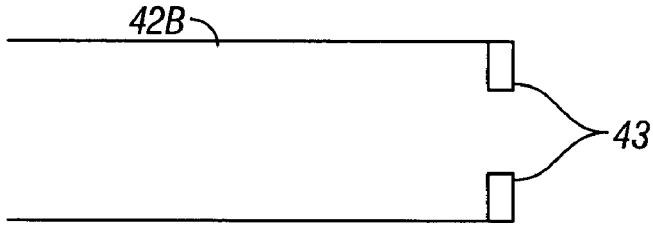
FIG. 3B is a sectional view of one embodiment of an opening in the dispenser body for receiving a suction cup.
Figure 3C:
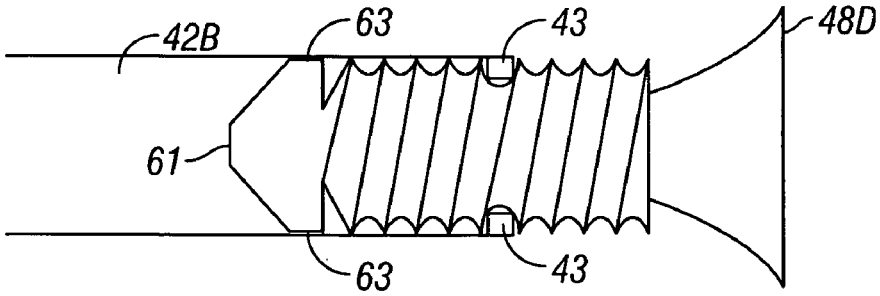
FIG. 3C is a sectional view of one embodiment of an opening in the dispenser body for receiving a suction cup with a suction cup inserted.

FIGS. 3A-3C illustrate another embodiment of apertures 42B of a liquid dispenser 26A. There is a retainer 43 associated with the apertures 42B for matingly connecting with threads of the suction cup 48D. FIG. 3C shows head 61 making suction cup 48D less likely to be removed from apertures 42B once inserted into apertures 42B. Preferably the shape of the head 61 helps prevent the removal of the head 61 by a child. Preferably the head 61 is shaped to include an outer wall 63 so as to tightly fit within the aperture 42B and increase contact between the head 61 and the dispenser body. This type of configuration of the head 61 also provides more rigidity to the suction cups in the fully extended outward position. If child safety is not an issue, then removability could be achieved by eliminating the head area.

Figure 4A:
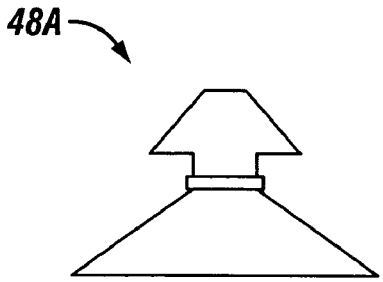
FIG. 4A is a front view of one embodiment of a suction cup according to the present invention.
Figure 4B:
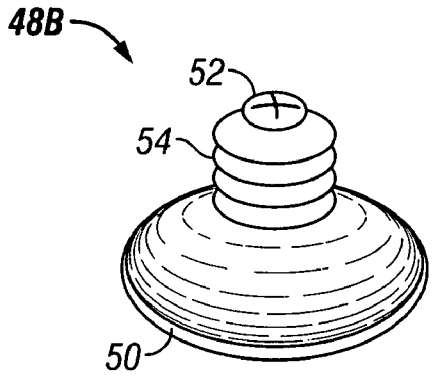
FIG. 4B is a perspective view of one embodiment of a height adjustable suction cup according to the present invention.
Figure 4C:
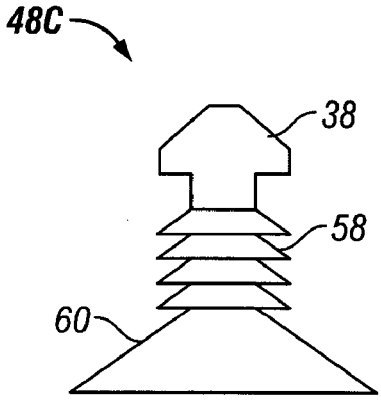
FIG. 4C is a front view of another embodiment of a height adjustable suction cup according to the present invention.
Figure 4D:
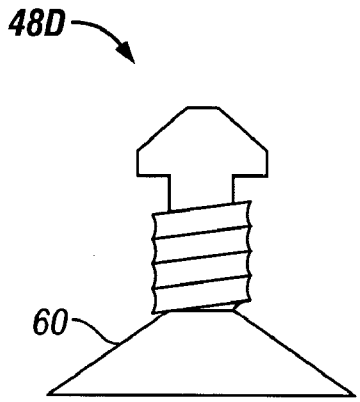
FIG. 4D is a front view of yet another embodiment of a height adjustable suction cup according to the present invention.

FIGS. 4A-4D illustrate exemplary embodiments of suction cups. FIG. 4A illustrates a typical suction cup 48A. FIGS. 4B-4D illustrate various embodiments of adjustable suction cups. In FIG. 4B, the suction cup 48B has a base 50. In addition, the suction cup 48B has a neck 54 that extends upwardly from the base 50. There is a screw 52 through the top portion of the neck 54 that is used to adjust the height of the suction cup 48B. The present invention contemplates that the neck 54 of the suction cup 48B can include a plurality of segments that can be added or removed to alter the height of the suction cup 48B. Alternatively, the neck 54 can be compressed through tightening the screw 52, or the suction cup 48B can otherwise be adjusted in height. Another method for using the suction cup 48B of FIG. 4B is to simply insert the neck 54 into an opening 46 (see FIG. 2C) to the desired height. This may result in some of the segments extending above and/or below the opening 46 shown in FIG. 2C.

The suction cup 48B can also be of permanent multiple segments rigid enough to span and support the desired fully adjusted position. The screw 52 is optional. Where used it provides additional rigidity and stability and allows for the addition of segments. The present invention contemplates that rigidity and stability can be increased in alternative ways as well.

FIG. 4C illustrates another embodiment of an adjustable suction cup 48C of the present invention. In FIG. 4C, the suction cup 48C has a base 60 opposite a top end 38. There are a plurality of segments 58 between the base 60 and the top end 38. The segments 58 can be compressed or expanded against one another in order to lower or raise the height of the suction cup 48C. The height of suction cup 48C is adjusted by expanding and collapsing the segments 58. According to the present invention, the suction cups can be height adjusted prior to insertion into the dispenser body. Adjustability can be accomplished by inserting a suction cup into a round aperture located in the back of the body. The suction cup can be pushed in until the proper number of segments are inserted for proper mounting. Threaded necks on the suction cups can also be placed in the round aperture until the desired distance is reached.

FIG. 4D illustrates suction cup 48D having a base 60. Suction cup 48D is a threaded suction cup. This allows the useable height of the suction cup 48D to be altered, especially when used in the embodiment shown in FIGS. 3A-3C. The suction cup 48D is merely screwed into or out of an aperture of the dispenser body in order to adjust the height of the suction cup 48D.

Because the suction cups are height adjustable, the dispenser body 32 of FIG. 2A can be more easily and conveniently adapted for use within a particular environment. For example, when the dispenser body 32 is to be inserted into the inside surface of a sink, the inside surface of the sink is often curved or contoured or sloped. The present invention allows the suction cups to be height adjusted so that the dispenser body can be secured to the inside surface of the sink in a manner that allows the dispenser body to be placed against or parallel with the surface of the sink. This results in the dispenser body being better secured to the sink, results in the dispenser body taking a smaller amount of space so as not to inconvenience those who use the sink. Although described in the context of a sink, the present invention contemplates that the same device (or other conforming designs) can be used in a bathtub or shower or other environment. The present invention also contemplates inserting the conforming design to a base that can change the shape of the back of the liquid dispenser. This filler would make the conforming design better adaptable and more appealing in various applications. The present invention also contemplates the use of various designs and logos on the dispenser such as character shapes, inserted pictures or objects, printed pictures, animals on the pump, sound effects, talking, different colors and materials, etc.

Figure 4E:
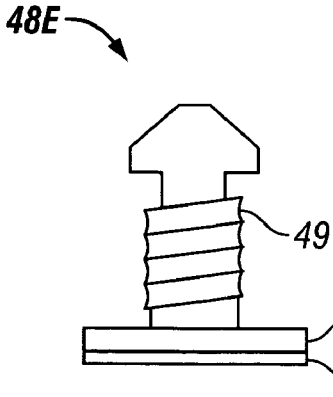
FIG. 4E is a front view of yet another embodiment of a height adjustable mounting means according to the present invention.

The present invention contemplates that other means of mounting a liquid dispenser can be used. The type of mount need not be limited to suction cups. One alternative embodiment is shown in FIG. 4E. The mounting means 48E is similar in appearance to the suction cup of FIG. 4D. The means of adjusting 49 of FIG. 4E can be accomplished in any number of ways, including by any of the previously discussed designs in FIGS. 4A-4D. Instead of having a suction cup base, however, there is a base 65 with adhesive pad 67 attached to the base 65. The adhesive pad 67 is mountable to a surface. The adhesive pad 67 is strong enough to support the weight of the liquid dispenser and preferably is waterproof to accommodate mounting in sinks, showers, baths, or other environments where water is a concern. Although it is preferred that either a suction cup or an adhesive pad is used, the present invention contemplates that other types of mounting means are used. Preferably such mounting means are easily removable and reattachable.

Figure 5A:
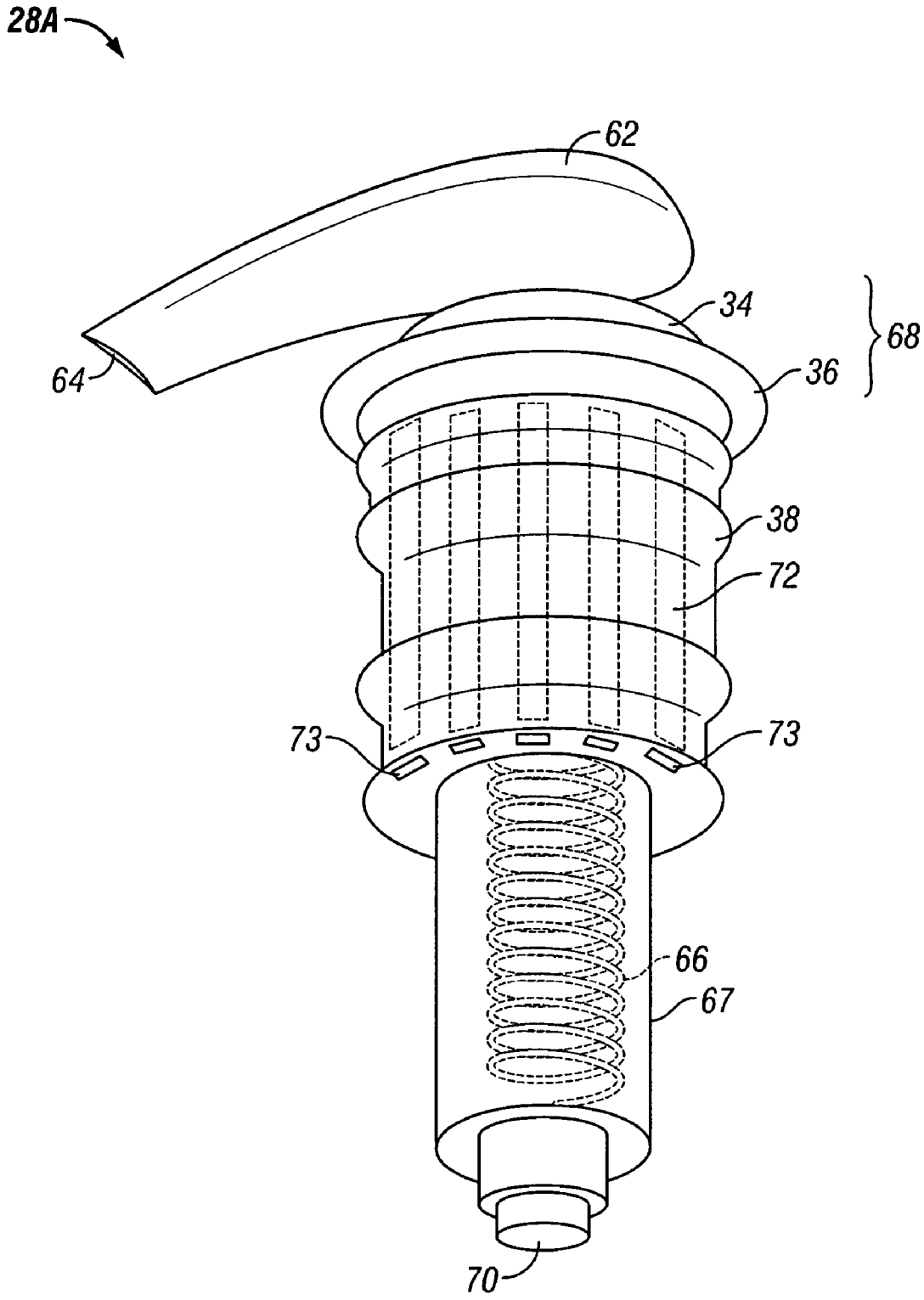
FIG. 5A is a perspective view of a push pump used in one embodiment of a liquid dispenser of the present invention.

FIGS. 5A-5E illustrates various embodiments of a push pump according to the present invention. In FIG. 5A, the push pump includes a neck 34 and a shoulder 36. The neck 34 can extend above the dispenser body. The shoulder 36 rests against the dispenser body. The push pump fits within the dispenser body. One method of attaching the push pump to the dispenser body is by securing it with thread 38. Preferably, the push pump 28A has a short stroke 68 to provide a compact pump assembly. The push pump 28A shown has an inside spring 66 and a piston pump area 67. An inlet 70 for the dispenser body is shown and an outlet 64 is shown on the pump head 62. Liquid, such as soap, is drawn through the inlet 70 and is secreted through the outlet 64. There are a plurality of air passages 72 shown that improve the push pump's ability to pump by venting the inner cavity from opening 73 to the atmosphere out the neck 34. The present invention contemplates any number of other variations in the design of the pump or dispenser body for functional or aesthetic purposes. Preferably, the pump is threaded as shown to allow for a more compact design. Compactability can also be provided through other means. For example, including through the design of the screw-on extendable neck. The piston diameter can be increased to decrease the stroke. The size of the extendable neck can be decreased. A push-on and lock type push pump can be used. The neck length on the pump head can be reduced. The present invention contemplates that all of these as well as other methods can be used to improve the compactness of the device.

Figure 5B:
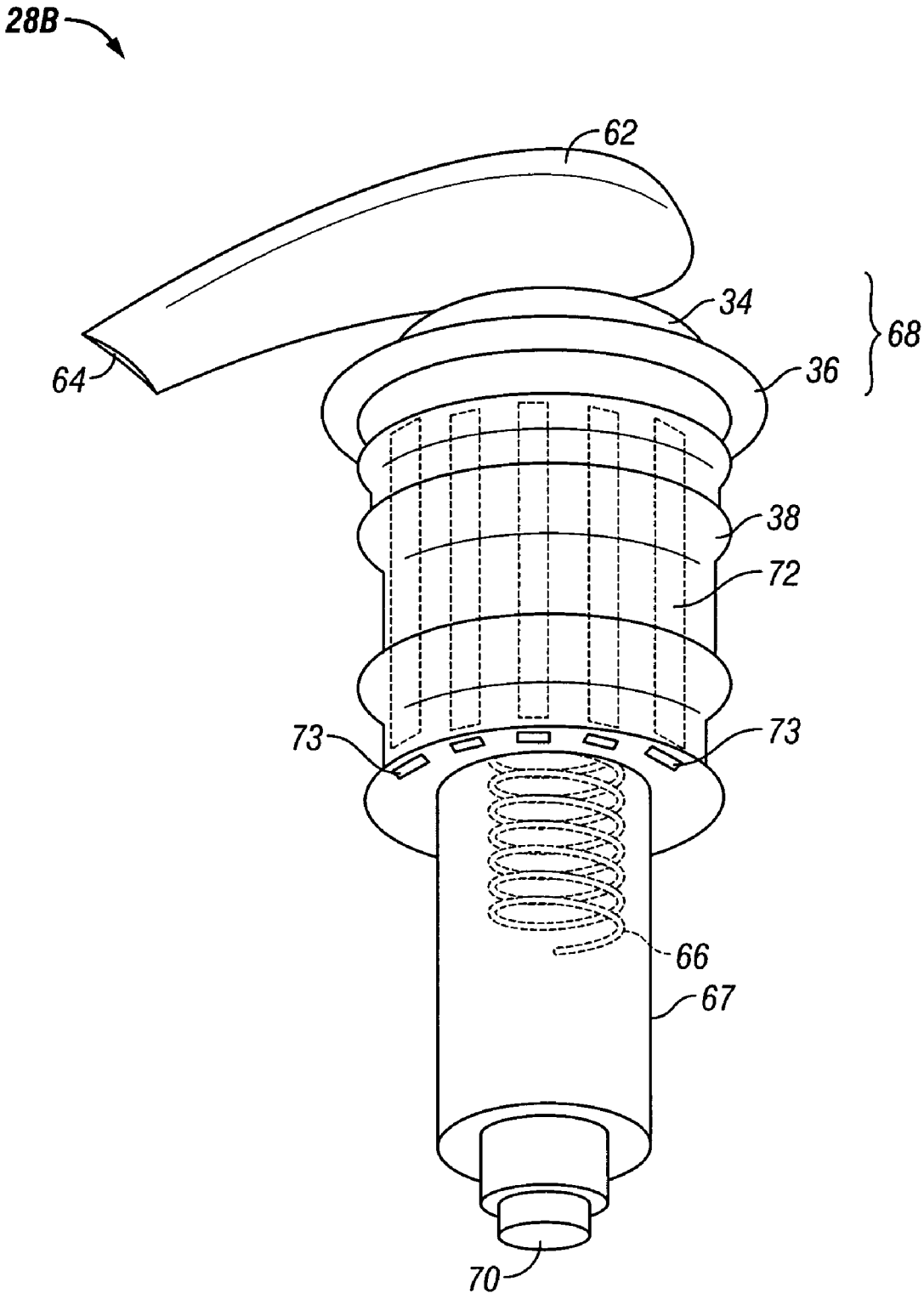
FIG. 5B is a perspective view of another embodiment of a push pump having a shorter spring to decrease output per pumping stroke.

In contrast to FIG. 5A, FIG. 5B illustrates a push pump 28B with a shorter spring 66 that decreases the output of liquid through outlet 64 when the pump head 62 is pumped. The shorter spring 66 decreases the output of liquid by causing a shorter stroke when the pump head 62 is pushed downward. This configuration may be desirable when children use the dispenser in order to decrease the possibility of a mess. However, the output of liquid can be immediately increased by pulling the pump head 62 up before pushing down on it to dispense liquid. Therefore, if an adult or other user needs more soap, the output of liquid can be increased without needing to change the spring 66 to a longer length.

Figure 5C:
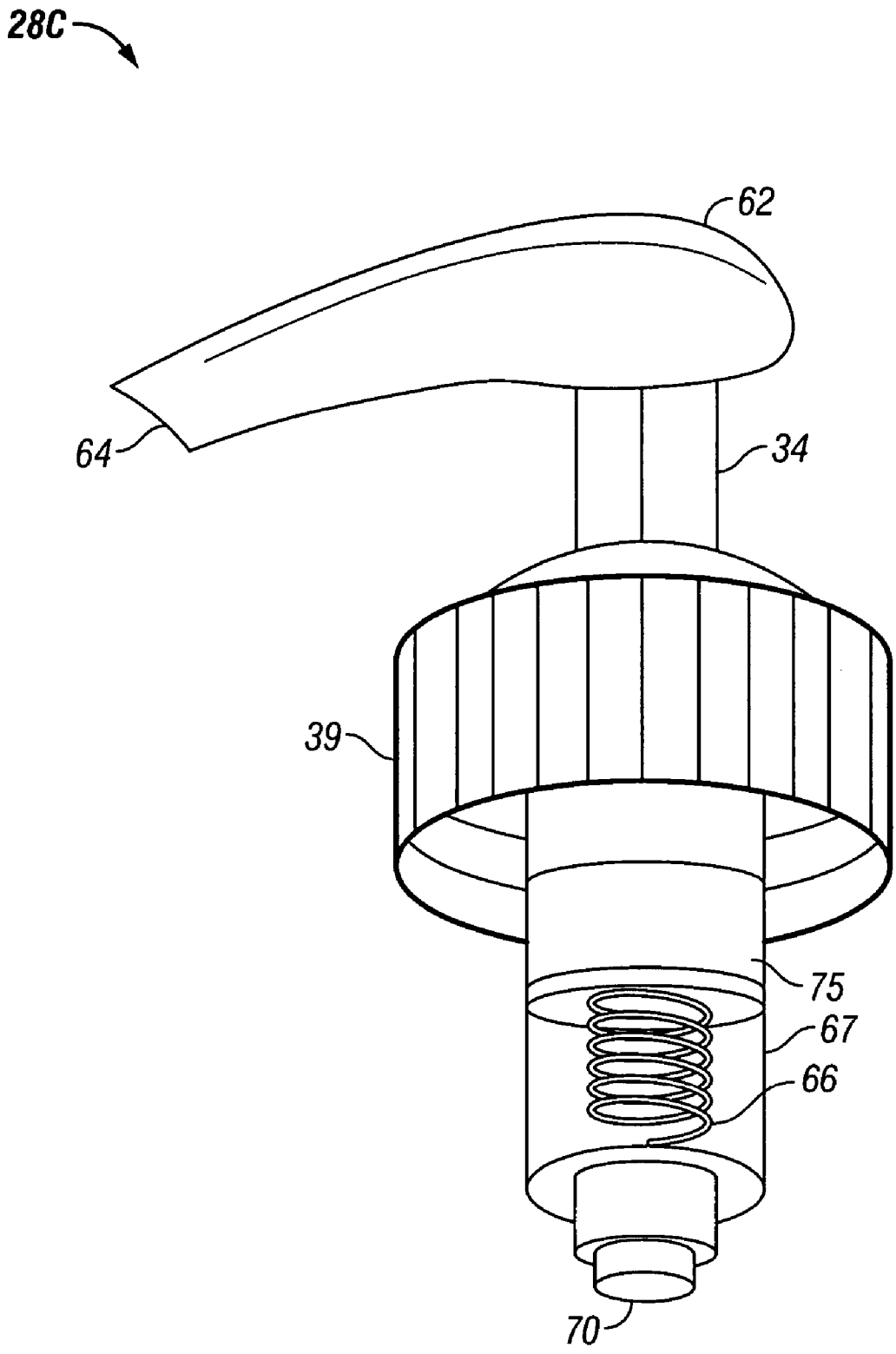
FIG. 5C is a perspective view of an embodiment of an adjustable output push pump illustrating a stop member that can be positioned to vary output.
Figure 5D:
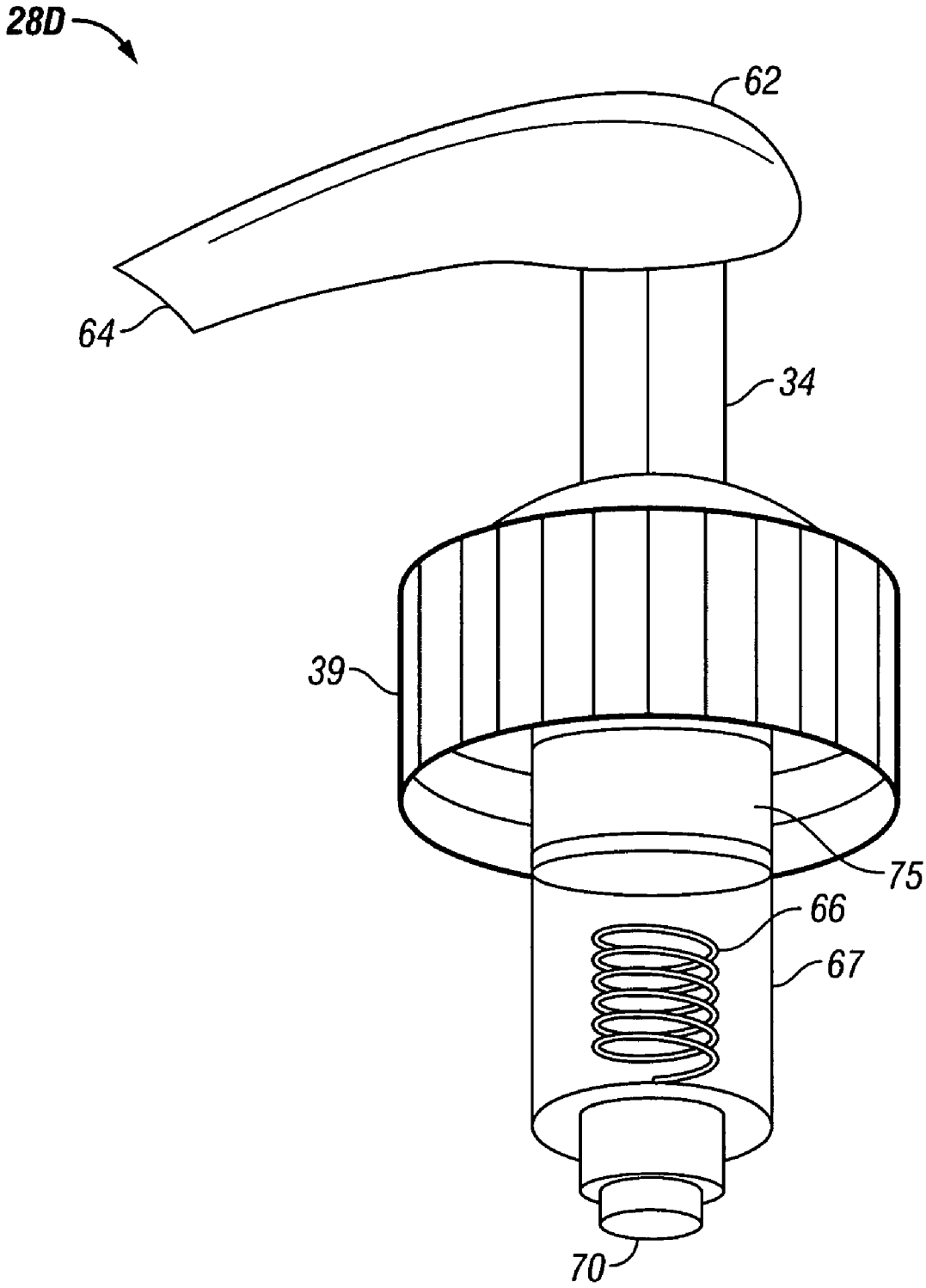
FIG. 5D is a perspective view of another embodiment of an adjustable output push pump illustrating a longer stroke that can be obtained by raising the stop member.

Referring to the push pump 28C of FIG. 5C, another embodiment of the invention is shown using an alternative means of regulating the output of liquid per pumping stroke. A stop member 75 is positioned within piston pump area 67. The stop member can be positioned at various points within piston pump area 67 in order to regulate the amount of liquid that dispenses through outlet 64 during a pumping stroke. If stop member 75 is positioned closer to inlet 70, the spring 66 is compressed to a shorter length which results in a shorter pumping stroke and decreases the amount of liquid secreted through outlet 64 during a pumping stroke. Alternatively, as in FIG. 5D, the push pump 28D includes a stop member 75 that can be positioned closer to pump head 62 which allows the spring 66 to expand. A longer spring length increases the length of the pumping stroke and increases the amount of liquid secreted through outlet 64 during a pumping stroke. In order to maximize output of liquid per pumping stroke in this embodiment, the stop member 75 should be positioned as close as possible towards the pump head 62 so the spring 66 is allowed to expand to its maximum length.

Figure 5E:
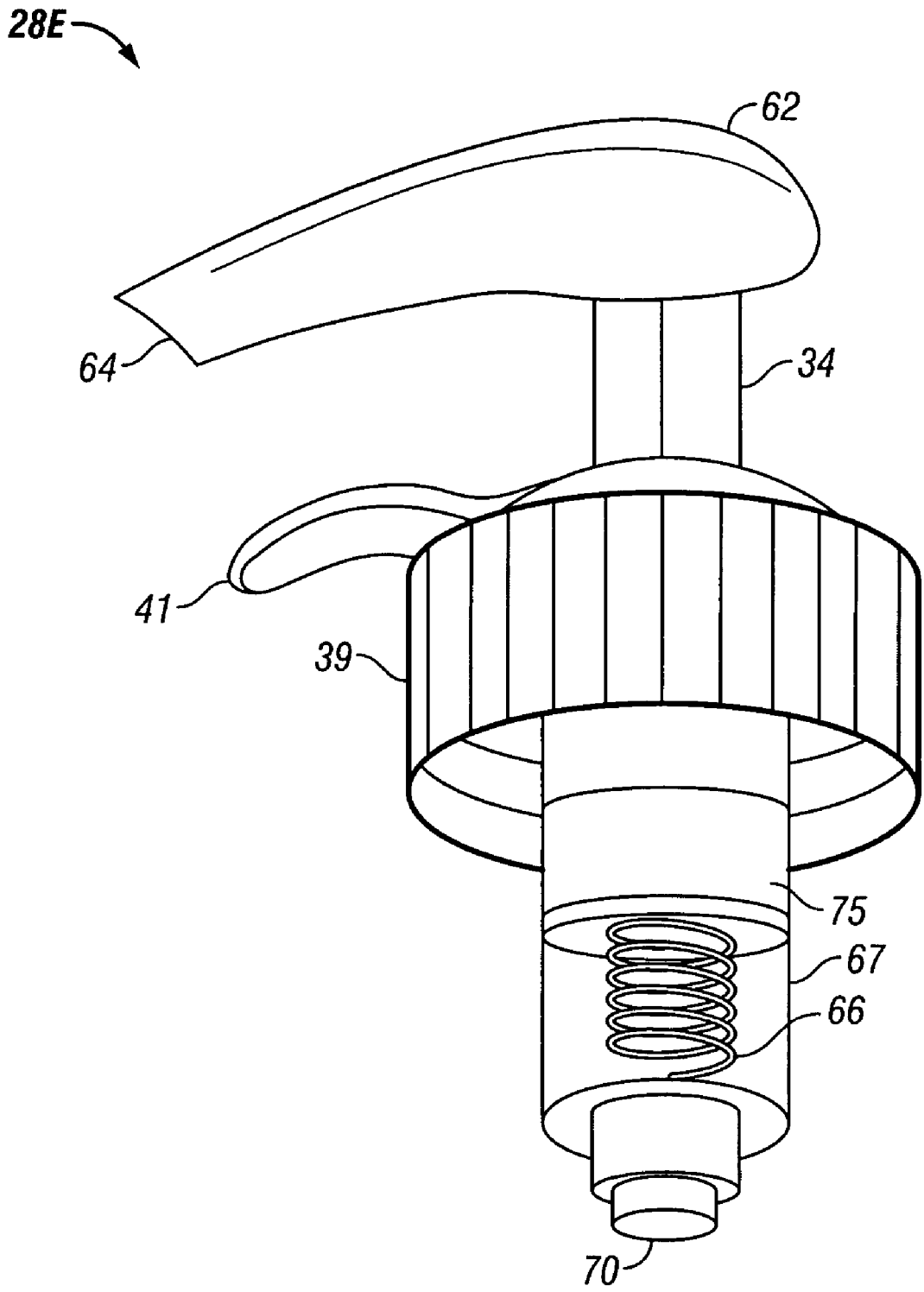
FIG. 5E is a perspective view of an adjustable output push pump illustrating a support member which can be added to the pump assembly to reduce forces on the dispenser body.

Referring to FIG. 5E, a push pump 28E includes a support member 41 is attached to cap member 39. The support member 41 serves to reduce pressure and forces on the other components of the dispenser as liquid is pumped from the dispenser. In one embodiment, the support member 41 is parallel with the pump head 62 and does not extend farther away from the neck 34 than the outlet 64 on the pump head 62. The support member cab be a part of the push pump or alternatingly can be molded into the body of the dispenser. The support member 41 and the pump head 62 can be squeezed together in a pinching action during the pumping process.

In a preferred embodiment of the present invention, the dispenser body has a conforming shape that allows it to fit snugly against various surfaces to which the liquid dispenser is mounted. The flexibility in mounting the liquid dispenser is further increased by providing the adjustable suction cups. Due to the conforming shape of the liquid dispenser, in at least some of the embodiments shown, the liquid dispenser can not rest freestanding on the bottom end of the liquid dispenser. Therefore, an adapter is also disclosed that can be used with the liquid dispenser for filling the liquid dispenser.

Figure 6A:
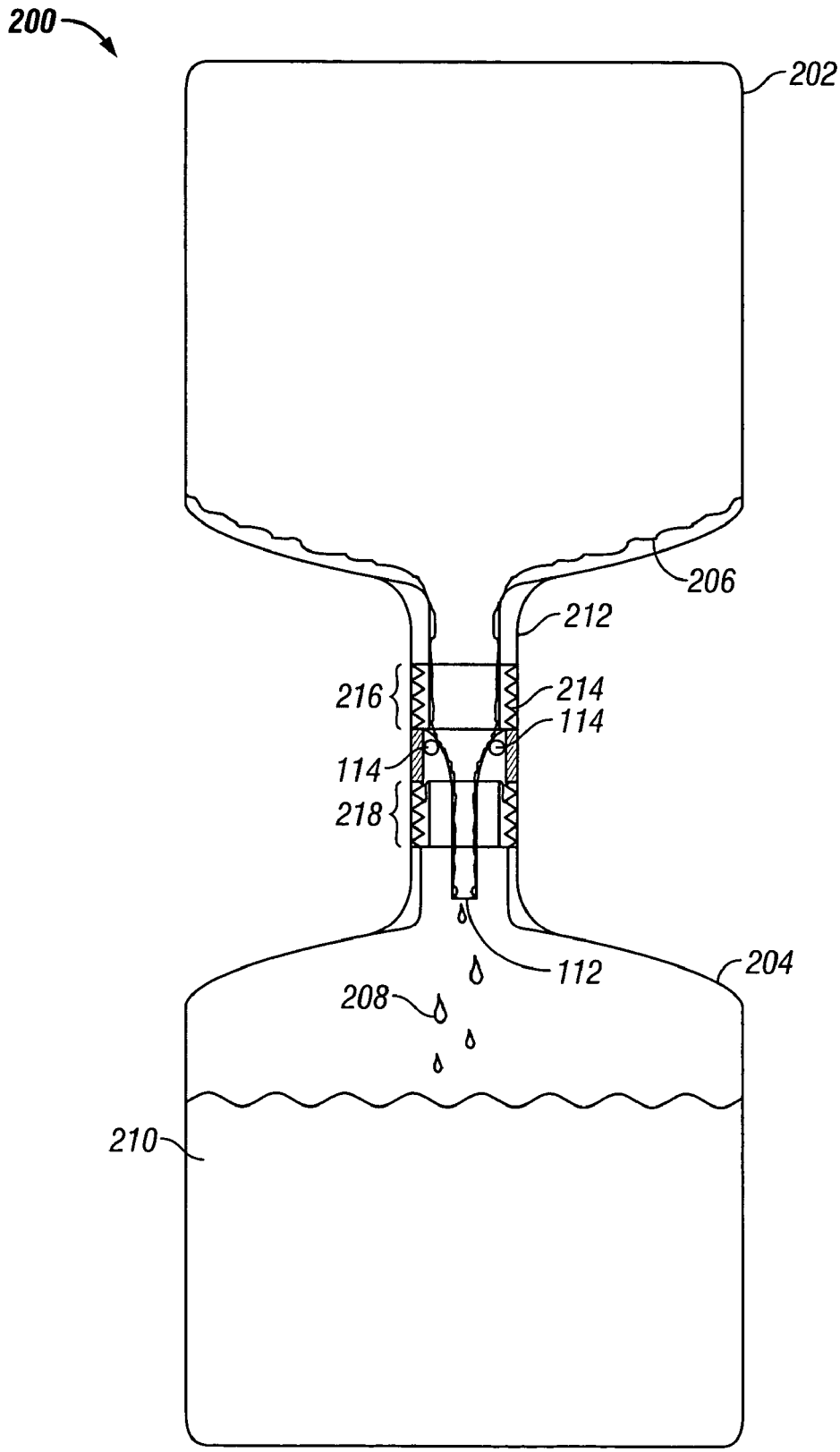
FIG. 6A illustrates one embodiment of a liquid dispensing adapter according to one embodiment of the present invention.
Figure 6B:
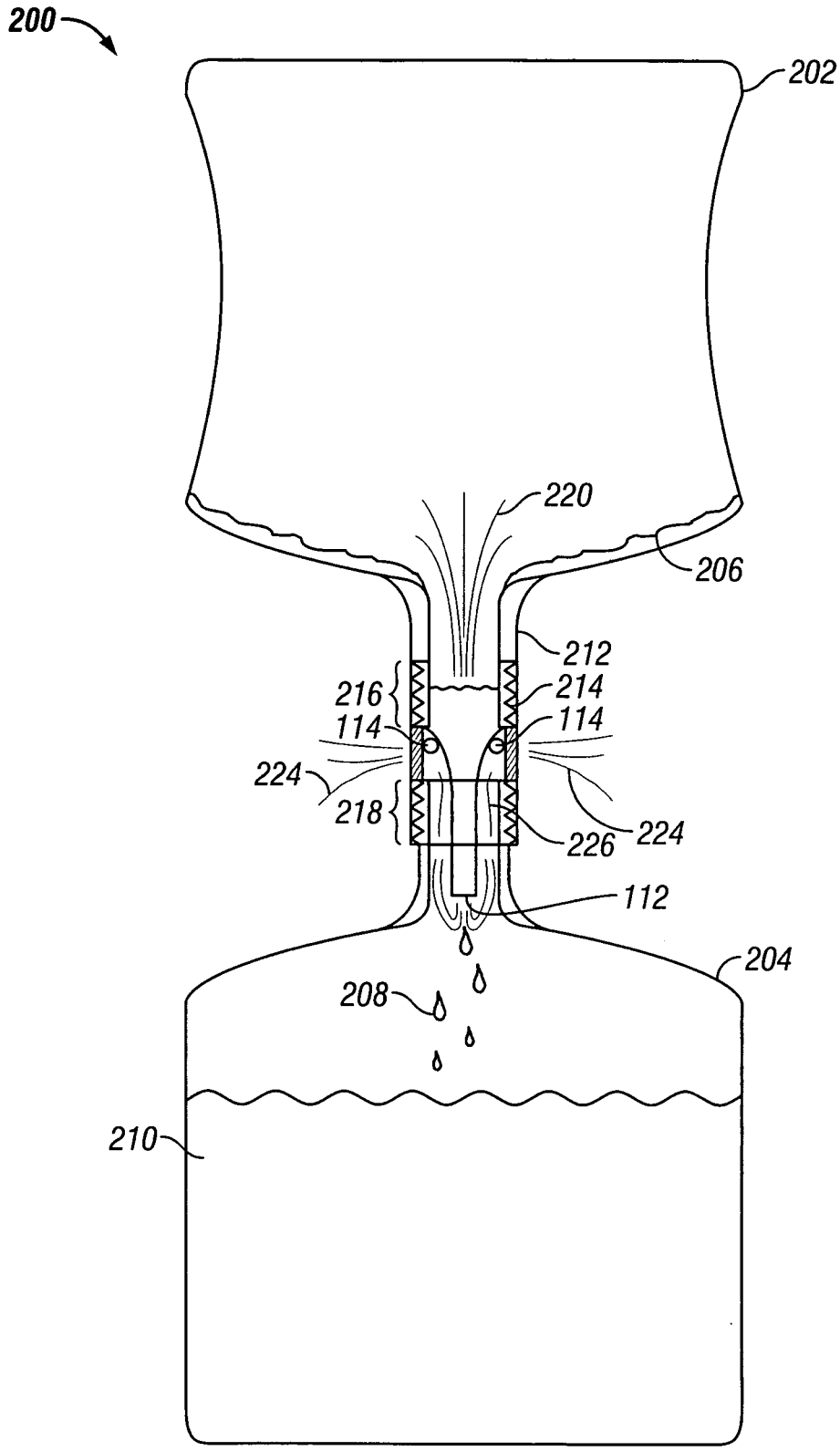
FIG. 6B illustrates the liquid dispensing adapter of FIG. 6A as pressure is applied to a top container.

FIGS. 6A and 6B illustrate basic liquid transfer from one container to another. In FIG. 6A, a system 200 is shown with a first container 202 and a second container 204. The first container 202 has a liquid 206 such as a liquid soap. The first container 202 has a neck 212. There is an adapter 214 that connects the first container 202 with the second container 204. The adapter 214 has first and second opposite ends 216 and 218. Both first end 216 and the second end 218 are threaded to fit the first container 202 and the second container 204. The present invention contemplates that the adapter need not be threaded to fit the first container 202 and/or the second container 204. In the specific embodiment of the adapter 214 shown, there is a tube 112 that is inserted into the second container 204 and there are vents 114 for air 226 (shown in FIG. 6B) to improve liquid flow from the first container 202 to the second container 204. Liquid 206 and air 226 in the first container passes through the adapter and through opening 112 to form drops 208 or a stream of liquid that are added to the liquid 210 in the second container 204 access air 224 and recovery (expansion air) pass in and out through vents 114. In FIG. 6B, air 220 helps aid in the flow of the liquid.

FIGS. 7-20 illustrate various embodiments of an adapter that can be used with the dispenser of the present invention. The adapters can be inserted into the dispenser body and then a liquid container, such as a bottle of soap. This allows the liquid container to be connected to the liquid dispenser body so that the dispenser can be refilled with liquid in a manner that is clean and efficient and to reduce the amount of wasted liquid that is left in the container.

Figure 7:
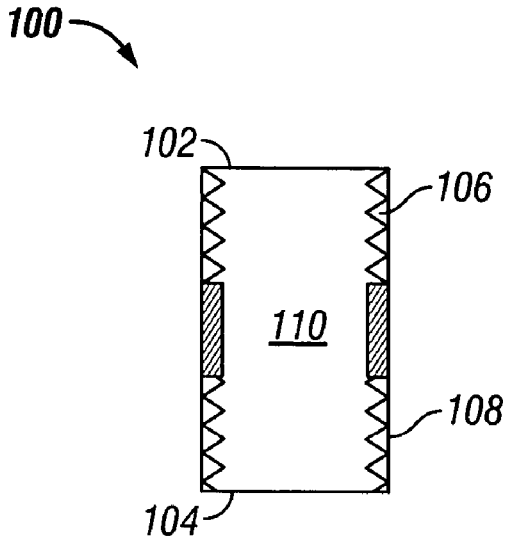
FIG. 7 is a sectional view of one embodiment of a liquid dispensing adapter of the present invention where both ends of the adapter are threaded.

For example, in FIG. 7, the adapter 100 has an adapter body 110 which includes a top end 102 and a bottom end 104. The top end includes threads 106 for fitting on a container of liquid and the bottom end includes threads 108 for fitting on another container of liquid.

Figure 8:
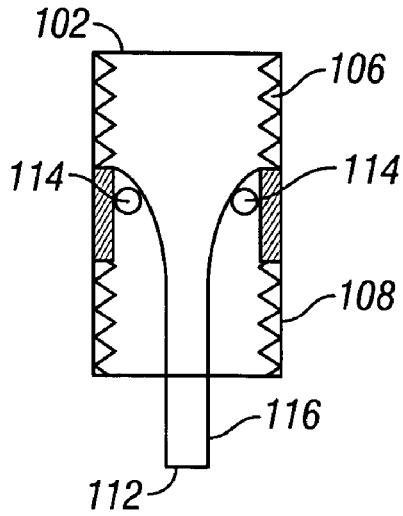
FIG. 8 is a sectional view of another embodiment of a liquid dispensing adapter of the present invention where both ends of the adapter are threaded, there is a tube for funneling liquid flow and there are air openings.

FIG. 8 illustrates another embodiment of an adapter. In FIG. 8, there are air passages 114 to encourage flow of liquid from a container fastened to the top end 102 to the container that is being filled. There is also a tube 116 with an outlet 112. The tube 116 and outlet 112 extend into the container that is being filled. This configuration reduces any likelihood of mess and the presence of the air passages 114 encourage the flow of liquid. Air passages 114 allow the filling container to be compressed and released to aid in the complete transfer of contents as shown in perspective FIGS. 6A and 6B.

Figure 9:
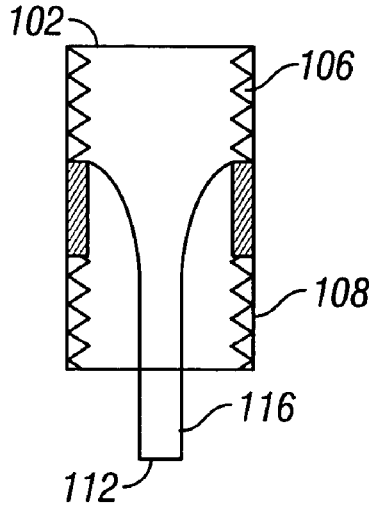
FIG. 9 is a sectional view of another embodiment of a liquid dispensing adapter of the present invention where both ends of the adapter are threaded and there is a tube for funneling liquid flow.
Figure 10:
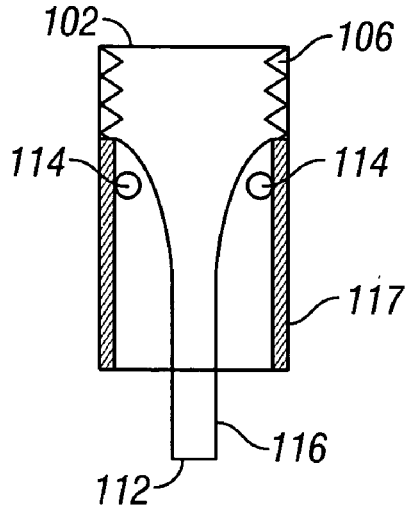
FIG. 10 is a sectional view of another embodiment of a liquid dispensing adapter of the present invention where one end is threaded, there is a tube for funneling liquid flow and there are air openings.
Figure 11:
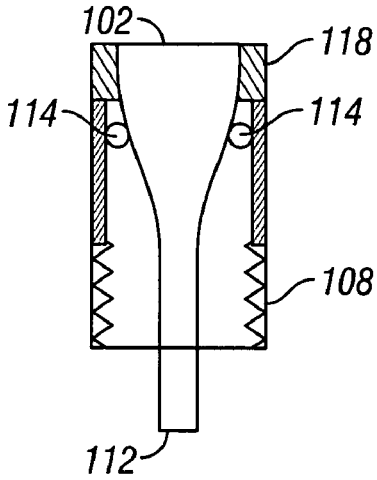
FIG. 11 is a sectional view of another embodiment of a liquid dispensing adapter of the present invention where one end is threaded, there is a tube for funneling liquid flow and there are air openings.
Figure 12:
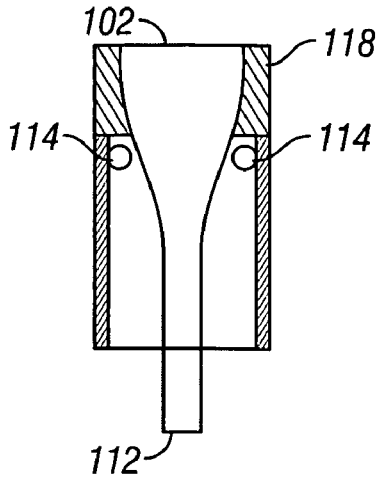
FIG. 12 is a sectional view of another embodiment of a liquid dispensing adapter of the present invention where there is a tube for funneling liquid flow and there are air openings.
Figure 13:
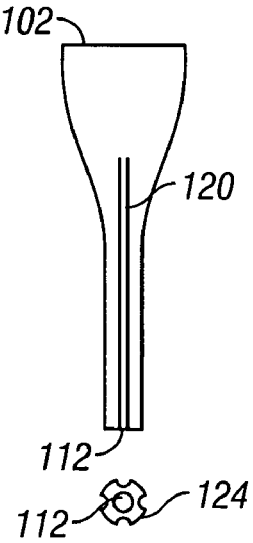
FIG. 13 is a sectional view of another embodiment of a liquid dispensing adapter of the present invention.

FIG. 9 illustrates another embodiment of the adapter. In FIG. 9, however, there are not air passages present. FIG. 10 illustrates another embodiment of the present invention. In FIG. 10, there is a smooth surface 117 on the bottom end of the adapter. FIG. 11 illustrates another embodiment of an adapter according to the present invention. In FIG. 11, there is a smooth surface 118 on the top end of the device, there are air passages 114 present, and the adapter includes an outlet 112 that would extend into the container that is being filled. FIG. 12 illustrates another embodiment without threads on either end. FIG. 13 illustrates another embodiment that includes one or more vent channels 120. The vent channels 120 which can be of various size apertures, allow internal air to leave the container while filling, eliminating blow back. The shape of the channels is shown as 124.

Figure 14:
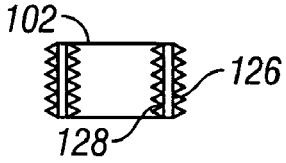
FIG. 14 is a sectional view of another embodiment of a liquid dispensing adapter of the present invention which is threaded.
Figure 15:
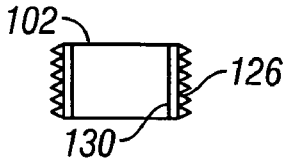
FIG. 15 is a sectional view of another embodiment of a liquid dispensing adapter of the present invention which is threaded.
Figure 16:
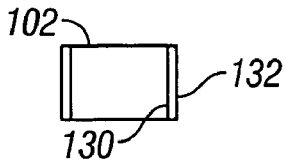
FIG. 16 is a sectional view of another embodiment of a liquid dispensing adapter of the present invention.

FIGS. 14-16 illustrate additional embodiments of the adapter of the present invention. In FIG. 14, the outer wall 126 of the adapter is threaded and the inner wall 128 is threaded. In FIG. 15, the outer wall 126 is threaded while the inner wall 130 is smooth. In FIG. 16, the inner wall 130 is smooth and the outer wall 132 is also smooth. FIGS. 14-16 allow more universal adaptation of FIGS. 7-13 and FIG. 17 to different size containers.

Figure 17:
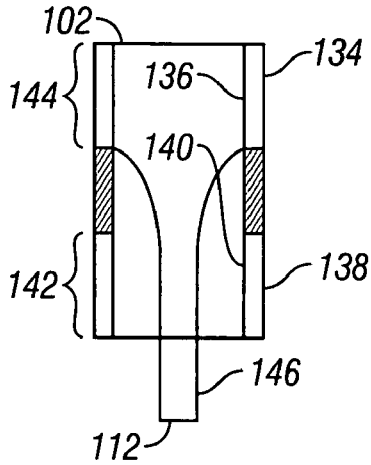
FIG. 17 is a sectional view of another embodiment of a liquid dispensing adapter of the present invention that includes a tube to funnel liquid.

FIG. 17 illustrates another embodiment of the adapter of the present invention where both the top end 144 and bottom end 142 are smooth. There is a tube 146 with an opening 112 for fitting within the container to which liquid is transferred. The top end 144 has a smooth inner wall 136 and a smooth outer wall 134. The bottom end 142 of the container has a smooth inner wall 140 and a smooth outer wall 138.

Figure 18:
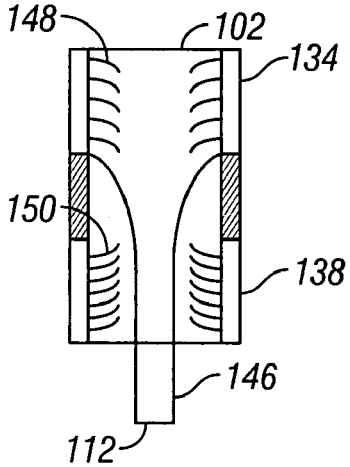
FIG. 18 is a sectional view of another embodiment of a liquid dispensing adapter of the present invention that includes a tube to funnel liquid and flexible barbed rows.
Figure 19:
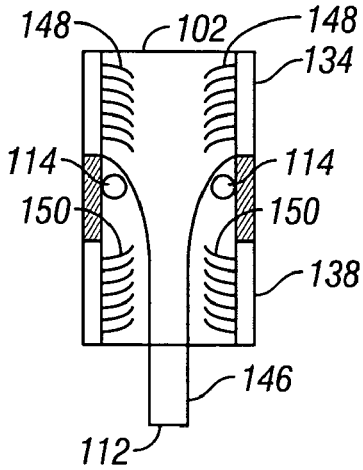
FIG. 19 is a sectional view of another embodiment of a liquid dispensing adapter of the present invention that includes a tube to funnel liquid and flexible barbed rows and there are air openings.
Figure 20:
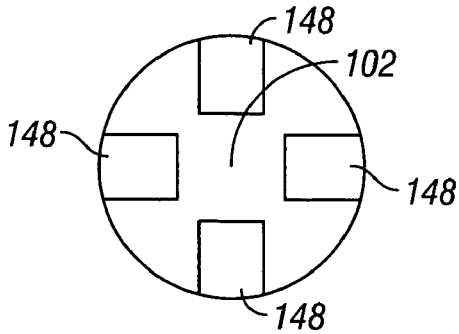
FIG. 20 is top view of an opening in the liquid dispensing adapter showing the flexible barbed rows.

FIGS. 18-20 illustrate various embodiments of the adapter of the present invention where barbed rows 148 and 150 are used. The barbed rows allow a more conforming fit to the threads associated with the first container and/or second container to which the adapter is connected. The barbed rows 148 are orientated generally opposite of the orientation of barbed rows 150. FIG. 20 illustrates a top view showing flexible barbs 148. These multiple vertical rows of flexible barbed material enable a user to push the adapter onto the threaded neck of containers of various sizes. When transfer is complete, the adapter can be unscrewed from each container.

The present invention includes the methodology of filling a container that is being filled. According to the methodology, preferably, the top end 102 of the adapter is placed onto the open end of a liquid container. The opposite end of an adapter is placed within the container that is being filled. The liquid container is positioned above the container that is being filled such that liquid within the liquid container flows downward, from the liquid container and into the container that is being filled. This allows emptying the liquid container while minimizing or eliminating the spillage. In addition, the present invention contemplates that because the adapter is secured to the container being filled and the liquid container, a person need not oversee this process. When the liquid within the liquid container is thick or slow pouring and the liquid container is nearly empty, it may take a significant amount of time to drain the liquid container. Once the containers are manually connected, forces can be applied to help expedite the full transfer of liquids while maintaining complete container to container contact. Because a person does not need to hold the liquid container to empty it and does not need to monitor the emptying process, this aspect of the invention provides additional convenience and increases the likelihood that the liquid container is fully drained.

The present invention also contemplates that the adapters can have different size fittings on either end of the tube to matingly connect containers of different sizes. The present invention includes the methodology of filling a container.

It should also be appreciated that certain benefits are derived from using the liquid dispenser with the adapter. For example, when the body of liquid dispenser is conformingly shaped it may not be capable of being freestanding on the bottom end as there is no substantially flat bottom surface. In such a case, the adapter aids in filling the liquid dispenser. The present invention contemplates that the liquid dispenser need not even be removed from where it is mounted. Rather, the push pump can be removed and the liquid dispenser can be filled using the adapter to connect the liquid dispenser to another container of liquid.

The liquid dispenser can also be packaged with one or more sets of removable mounts such as suction cups to mount the liquid dispenser to various surfaces. The liquid dispenser and the accompanying adapter are preferably comprised of a dishwasher safe material to aid in cleaning and sanitizing between uses.

The present invention contemplates numerous variations in materials used, configurations, shapes, sizes, and other variations within the scope of the invention now claimed.

What is claimed is:

1. A liquid dispenser comprising:

a mounting surface for mounting the liquid dispenser;

a liquid container body having an inner cavity for containing a liquid and an aperture providing access to the inner cavity;

the liquid container body having a front surface and an opposite back surface, and the back surface sloping downwardly and inwardly from a top of the liquid container body to a bottom of the liquid container body;

a pump removably fitted within the aperture, and being adapted to pump the liquid from the cavity to outside the container body;

a first and a second mount attached to the back surface of the container body at different distances from the top surface, the first mount being closer to the top surface than the second mount; and each of the mounts being adjustable from the container body in the direction of the mounting surface so as to mount the container body to the mounting surface to assist in fitting the liquid container body to the mounting surface.

2. A liquid dispenser according to claim 1 wherein the first and second mounts are suction cups.

3. A liquid dispenser according to claim 1 wherein a body opening is provided in the container body for each of the first and second mounts, the mounts being inserted into each of body openings.

4. A liquid dispenser according to claim 3 wherein each of the body openings contains a larger opening portion laterally of a smaller opening portion, the first and second mounts inserted into the larger opening portion and slipped into the smaller opening portion.

5. A liquid dispenser according to claim 3 wherein each of the mounts have a mounting neck.

6. A liquid dispenser according to claim 5 wherein each of the mounting necks has a plurality of segments that can be inserted into the opening to retain the first and second mounts to the container body.

7. A liquid dispenser according to claim 6 wherein the mounting surface is further away from the container body with respect to one mount of the first or second mount.

8. A liquid dispenser according to claim 1 wherein the container body further comprises a front surface and an opposite back surface, wherein the front and opposite surfaces are shaped to accommodate and conformingly fit a number of types of sinks and other surfaces.

9. A liquid dispenser according to claim 1 wherein each height of the first and second mount can be adjusted to a plurality of positions so as to allow the container body to be placed against or parallel to the mounting surface.

10. A liquid dispenser comprising:

a mounting surface for mounting the liquid dispenser;

a liquid container body having an inner cavity for containing a liquid and an aperture providing access to the inner cavity;

a pump removably fitted within the aperture, and being adapted to pump the liquid from the cavity to outside the container body;

a pump neck on the pump extending outside the inner cavity of the container body;

a dispenser body on the pump located within the inner cavity of the container body;

a plurality of air cavities extending from the dispenser body to the pump neck outside the inner cavity for providing atmosphere to the inner cavity of the container body;

at least two mounts attached to the container body;

the at least two mounts spanning the container body and the mounting surface and being attached to the mounting surface, each of the at least two mounts being adjustable from the container body in the direction of the mounting surface so as to mount the container body to the mounting surface;

a body opening in the container body for each of the at least two mounts, the at least two mounts being inserted into each of body openings;

wherein each of the body openings contains a larger opening portion laterally of a smaller opening portion, the at least two mounts inserted into the larger opening portion and slipped into the smaller opening portion.

11. The liquid dispenser of claim 10 wherein the at least two mounts each include a base, a neck connected to the base, and a head connected to the neck.

12. The liquid dispenser of claim 11 wherein the neck is threaded.

13. The liquid dispenser of claim 11 wherein the neck is extendable.

14. The liquid dispenser of claim 11 wherein the base is a suction cup.

15. The liquid dispenser of claim 11 wherein the base includes an adhesive.

* * * * *